US005960793A

United States Patent [19]

Matsuoka et al.

[11] Patent Number: 5,960,793

[45] **Date of Patent: *Oct. 5, 1999**

[54] BREATHING DEVICE FOR DIVING

[75] Inventors: Shunsuke Matsuoka; Kiyoshi Hashimoto, both of Chiba-ken, Japan

[73] Assignee: Grand Bleu Inc.

[ * ] Notice: This patent is subject to a terminal disclaimer.

[21] Appl. No.: 08/894,682

[22] PCT Filed: Dec. 26, 1996

[86] PCT No.: PCT/JP96/03871

§ 371 Date: Oct. 20, 1997

§ 102(e) Date: Oct. 20, 1997

[87] PCT Pub. No.: WO97/24259

PCT Pub. Date: Jul. 10, 1997

[30] Foreign Application Priority Data

Dec. 28, 1995 [JP] Japan ..... 7-341987

[51] Int. Cl.[6] ..... A61M 16/00; A62B 7/04; F16K 31/26

[52] U.S. Cl. ..... 128/204.26; 128/201.26; 128/201.27

[58] Field of Search ..... 128/201.27, 201.26, 128/204.18, 204.26, 205.12, 205.24, 205.25

[56] References Cited

U.S. PATENT DOCUMENTS

| | | | |
|---|---|---|---|
| 2,456,130 | 12/1948 | Lambertsen | 128/202.19 |
| 3,123,680 | 3/1964 | Minton, Jr. et al. | 128/201.19 |
| 5,127,398 | 7/1992 | Stone | 128/204.18 |
| 5,209,226 | 5/1993 | Goodley | 128/205.25 |
| 5,368,018 | 11/1994 | Stone | 128/201.28 |
| 5,379,762 | 1/1995 | Kobayashi | 128/201.28 |
| 5,720,279 | 2/1998 | Furuichi et al. | 128/204.26 |
| 5,724,961 | 3/1998 | Tistrand | 128/205.24 |
| 5,839,435 | 11/1998 | Matsuoka et al. | 128/205.12 |

FOREIGN PATENT DOCUMENTS

| | | |
|---|---|---|
| 59-57090 | 4/1984 | Japan . |
| 3-220091 | 9/1991 | Japan . |
| 5-293190 | 11/1993 | Japan . |
| 7-25383 | 1/1995 | Japan . |
| 7-25384 | 1/1995 | Japan . |
| 7-101388 | 4/1995 | Japan . |
| 7-215286 | 8/1995 | Japan . |

*Primary Examiner*—Aaron J. Lewis
*Assistant Examiner*—Joseph F. Weiss, Jr.
*Attorney, Agent, or Firm*—Burns, Doane, Swecker & Mathis LLP

[57] ABSTRACT

A mouth piece unit (6) for a semi-closed type breathing device (1) in which when pressing down a start button (102), the entirety of a movable assembly (70) moves and an external opening (73) opens, whereby a mouth piece (62) is caused to protrude, allowing a diver to hold it in his/her mouth. Since the movable assembly (70) is held at that position even if the start button (102) is restored, an inhalation gas supply valve (21) is held in an open state by an engagement bar (74), whereby the supply of inhalation gas is continued. When the mouth piece (62) comes out of the mouth of the diver, the movable assembly (70) is restored and the external opening (73) is automatically closed, thereby preventing water from entering the inside therethrough from the outside. To drain water, when the start button (102) is kept pressed down, purge gas is supplied from a purge gas supply valve (22), a water draining opening (120) opens, and a breathing air hose connecting port (61a) is closed, this allowing water to be automatically drained. Thus, it is possible to realize a mouth piece unit for a semi-closed type breathing device that can easily be used by a novice.

4 Claims, 6 Drawing Sheets

BREATHING DEVICE FOR DIVING

TECHNICAL FIELD

This invention relates to a mouth piece unit for a breathing device such as a semi-closed type breathing device, and in particular to a mouth piece unit for a breathing device that can easily be used by a beginner.

BACKGROUND ART

Breathing devices for diving can be broadly divided into two types, one type being an open-type breathing device and the other type a closed-type or semi-closed type breathing device. In an open-type breathing device, gas that has been breathed once is expelled from the device, but a closed-type or semi-closed type breathing device includes an apparatus that enables gas that has been breathed to be used again.

A closed-type or semi-closed type breathing device generally has the advantage of being lighter than an open-type breathing device and permitting longer dives to deeper depths. However, since conventional closed-type or semi-closed type breathing devices were developed for specialized diving applications or military use, they were equipped with only a minimum of safety mechanisms, and has no mechanisms for coping with emergency situations that occur relatively easily. For this reason, rigorous training was required to use this type of device, and thus it could not be readily used by recreational divers.

However, the growing popularity of diving generated increasing demand for closed-type or semi-closed type breathing devices that were not overly complicated to operate and did not require such rigorous training.

Equipped as it is with oxygen concentration sensors and the like, a closed-type breathing device requires considerable training with respect to handling, control and monitoring. In contrast, a semi-closed type breathing device has no such equipment and therefore can be operated without training, so it can be handled relatively easily even by a non-expert.

Semi-closed breathing devices that are simpler and easier to use than before would be highly convenient. There are various improvements that can be implemented to make such semi-closed type breathing devices more readily accessible than before.

For example, since the pressure in the mouth piece and in inhalation and exhalation passages in communication with the mouth piece is about the same as the surrounding pressure, outside water can enter the device via the mouth piece.

If a person using the device is novice, there is quite a high possibility that while submerged the mouth piece may become dislodged from the person's mouth, allowing water to enter the device through the mouth piece. This water can have an adverse effect, such as on the carbon dioxide gas adsorption device. Thus, a mechanism that does not allow the intrusion of water into the device is desirable, and there is a need for a mechanism that will automatically expel any water that does enter.

In the case of an inhalation passage, this type of problem can be resolved by the provision of a check valve at the connection between the inhalation air hose and mouth piece that only permits a fluid to pass from the inhalation air hose to the mouth piece. However, a check valve does not solve the problem in the case of exhalation passage, since exhaled air has to be passed from the mouth piece to the exhalation air hose, so a different contrivance is required.

In contrast, because an open-type breathing device does not have an exhalation air hose and the pressure inside the inhalation air hose is higher than the surrounding pressure, the entry of outside water into the device via the mouth piece does not occur.

Concerning this point, in International Patent Publicly Disclosure No. WO 95/09762 the applicant of this patent application proposed a mouth piece unit that is easy to use, even by a novice. This mouth piece unit has a manually operated assembly, operation of which caused chewing pieces to project out from the mouth piece, and the diver continues to be supplied with fresh breathing gas as long as the chewing pieces are held in the mouth. If the diver should accidentally let the mouth piece come out of his or her mouth, the chewing pieces retract into the mouth piece unit, closing off the exhalation air hose. Thus, the result is that the entry of water is prevented automatically.

In addition to the manually operated assembly, a purge lever is provided that when operated causes fresh breathing gas to be delivered at a high flow rate to purge the mouth piece unit of water. Thus, a diver can expel any water in the mouth piece unit simply by operating this purge lever.

DISCLOSURE OF THE INVENTION

An object of the present invention is to realize the similar functions as those of the mouth piece unit proposed by the applicant of the present application by means of different mechanisms, to thereby provide a mouth piece unit that is easy to use even by a novice.

Namely, an object of the present invention is to provide a mouth piece unit that automatically prevents entry of water into the unit if the mouth piece comes out of a diver's mouth.

An object of the present invention is also to provide a mouth piece unit that supplies breathing gas only when it is required to suppress the amount of breathing gas to be wasted as much as possible.

A further object of the present invention is to provide a mouth piece unit that is able readily to purge an interior of a mouth piece of water.

To attain the above objects, a mouth piece unit according to the present invention is characterized by providing the following constitution defined by (a) to (e);

(a) a unit case provided therein with an inhaled/exhaled air circulation chamber which has an exhalation air hose connecting port communicated with an exhalation air hose for circulating exhaled gas and an inhalation air hose connecting port communicated with an inhalation air hose for circulating inhalation gas;

(b) a movable assembly having a mouth piece and an external opening for communicating the inhaled/exhaled air circulation chamber to the outside, which is movably mounted in the unit case so that it can be moved between a retracted position wherein the mouth piece is retracted into the unit case and a projected position wherein the mouth piece is projected out from the unit case to allow it to be held in a diver's mouth;

(c) a stationary assembly having an external opening shutoff valve which is arranged at a fixed position in the unit case so as to face the external opening;

(d) a resilient means for pressing the movable assembly against the side of the stationary assembly to hold the mouth piece in the retracted position in order to close the external opening by means of the external opening shut-off valve; and (e) a manually operating assembly which is mounted in the unit case so as to move from an initial position to an operated position and is normally held in the initial position by means of resilient force, and which forces to move the movable assembly so that the mouth piece reaches the projected position in response to the movement from the initial position to the operated position thereof, while it returns to the initial position from the operated position by the resilient force without interlocking with the movable assembly.

According to the mouth piece unit constituted above, when it is used, the diver presses the manually operating assembly to the operated position against the resilient force. With this movement of the manually operating assembly, the movable assembly is forced to move against the resilient force exerted from the resilient means, whereby the mouth piece mounted on the external opening thereof is caused to project from the unit case and reach the projected position. As a result, it becomes possible for the diver to hold the projected mouth piece in the mouth. At the same time, the external opening becomes away from the external opening shut-off valve means of the stationary assembly, allowing the inhaled/exhaled air circulation chamber to communicate to the outside through the external opening.

When the manually operating assembly is released with the mouth piece being held in the mouth piece, it is restored to the initial position by resilient force. At this time, however, since the mouth piece is held in the mouth of the diver, it is kept in its position irrespective of the movement of the manually operating assembly. Thus, the external opening is maintained in an open state, allowing the diver to breath via the mouth piece.

If the diver dislodges the mouth piece from the mouth, for example, dislodges it from the mouth accidentally during diving, the movable assembly to which the mouth piece is affixed is returned to the initial position by means of the resilient means, and as a result the external opening formed on the movable assembly is forced to abut against the external opening shut-off valve means and is closed accordingly.

Thus, since the external opening is automatically closed upon dislodgement of the mouth piece from the diver's mouth, it is possible to prevent a large amount of water from entering from the outside.

Next, a mouth piece unit for a breathing device for diving according to the present invention is characterized by further comprising the following constitution defined by (f) and (g):

(f) a gas supply means for supplying a constant flow rate of fresh inhalation gas into the inhaled/exhaled air circulation chamber from a breathing gas cylinder; and (g) an opening means formed on the movable assembly for shifting the gas supply means into an open state from a closed state in response to the movement of the movable assembly when it is moved to cause the mouth piece to reach the projected position.

According to the mouth piece unit constituted above, when it is used, the diver presses the manually operating assembly to the operated position against the resilient force. With this movement of the manually operating assembly, the movable assembly is forced to move against the resilient force exerted from the resilient means, whereby the mouth piece mounted on the external opening thereof is caused to project out from the unit case and reach the projected position. As a result, it becomes possible for the diver to hold the projected mouth piece in the mouth. At the same time, the external opening becomes away from the external opening shut-off valve means of the stationary assembly, allowing the inhaled/exhaled air circulation chamber to communicate to the outside through the external opening.

When the manually operating assembly is released with the mouth piece being held in the mouth piece, it is restored to the initial position by resilient force. At this time, however, since the mouth piece is held in the mouth of the diver, it is kept in its position irrespective of the movement of the manually operating assembly. Thus, the external opening is maintained in an open state, allowing the diver to breath via the mouth piece.

If the diver dislodges the mouth piece from the mouth, for example, dislodges it from the mouth accidentally during diving, the movable assembly to which the mouth piece is affixed is returned to the initial position by means of the resilient means, and as a result the mouth piece is also returned to the retracted position. When the movable assembly is returned to the initial position, in response to which, the gas supply means returns to an closed state to stop the supply of fresh inhalation gas. At the same time when the movable assembly returns to the initial position, the external opening formed on the movable assembly is forced to abut against the external opening shut-off valve means of the stationary assembly and is closed.

Thus, since the supply of fresh inhalation gas is automatically stopped upon dislodgement of the mouth piece from the mouth, consumption of gas to be wasted can be suppressed. Further, the external opening is also closed, and therefore it is possible to prevent a large amount of water from entering from the outside.

Next, a mouth piece unit for a breathing device for diving according to the present invention is characterized by further comprising the following constitution defined by (h) to (l) in addition to (a) to (g) as mentioned above:

(h) a purge gas supply means for supplying gas at a flow rate higher than a constant flow rate of inhalation gas from the breathing air cylinder to the inhaled/exhaled air circulation chamber;

(i) a water draining opening for communicating the inhaled/exhaled air circulation chamber to the outside via a check valve means;

(j) a water draining opening shut-off valve means which keeps the water draining opening in a closed state and which makes the water draining opening to an open state in response to the movement of the movable assembly when it is moved to cause the mouth piece to reach the projected position;

(k) an opening means for opening the purge gas supply means in response to the movement of the movable assembly when it is moved to cause the mouth piece to reach the projected position; and (l) an exhalation air hose shut-off valve means for closing the exhalation air hose connecting port in response to the movement of the movable assembly when it is moved to cause the mouth piece to reach the projected position According to the mouth piece unit of the present invention as constituted above, water in the mouth piece can be discharged by pressing to move the manually operating assembly from the initial position to the operated position and maintaining it in the operated position. More specifically, when the manually operating assembly is maintained in the operated position, the purge gas supply means is kept open, the water draining opening shut-off valve means is also kept open, while the exhalation air hose connecting port is kept closed by the exhalation air hose shut-off valve means.

As a result, the inhaled/exhaled air circulation chamber is supplied with a high flow rate of fresh inhalation gas as water purging gas via the purge gas supply means. Thus, the inhaled/exhaled air circulation chamber becomes high in pressure compared to the outside, thereby discharging water accumulated therein to the outside together with gas through the water draining opening. Releasing or the manually operating assembly allows it to return to the initial position by resilient force, whereby the purge gas supply means is closed, the water draining opening shut-off valve means is returned to an closed state, and the exhalation air hose connecting port is returned to an open state.

Accordingly, automatic water discharge can be carried out by pressing to move the manually operating assembly to the operated position and maintaining it in that position.

BEST MODE FOR CARRYING OUT THE INVENTION

An example of a semi-closed type breathing device that has a mouth piece unit according to the present invention will now be described, with reference to the drawings.

Overall Structure

Figure 6:
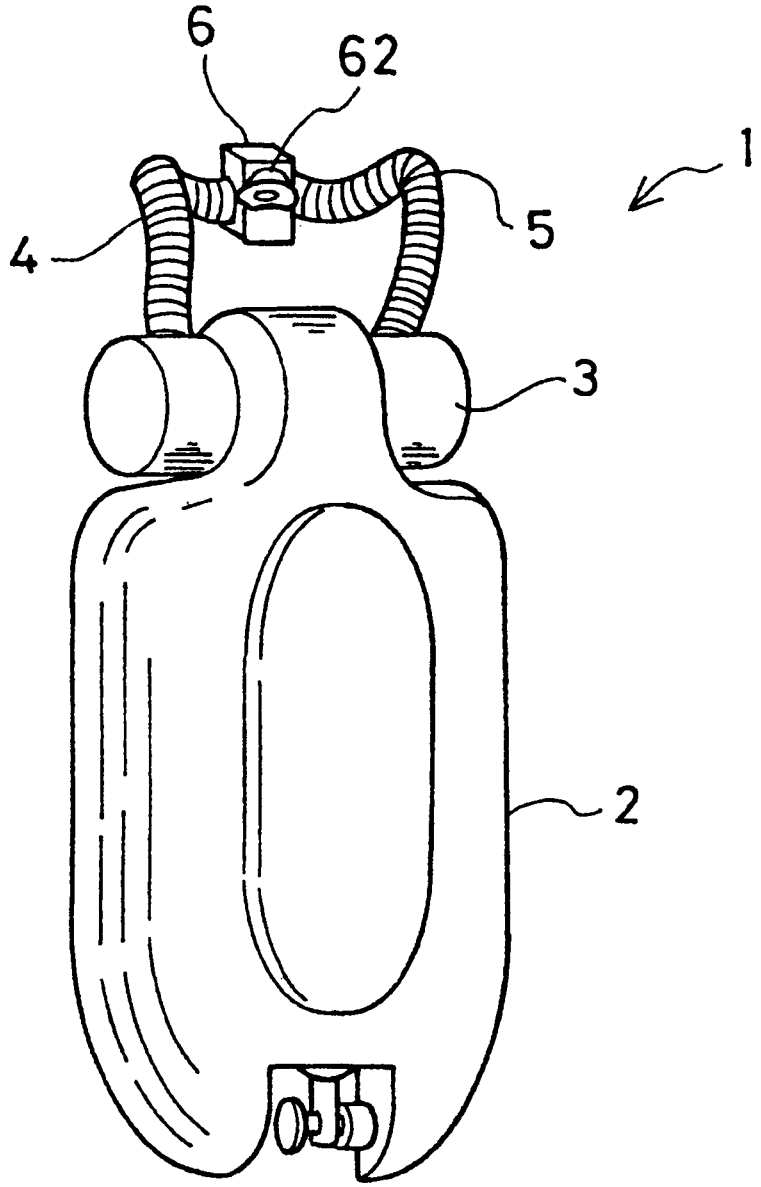
FIG. 6 is an external perspective view of a semi-closed type breathing device equipped with the mouth piece unit of FIG. 1.
Figure 7:
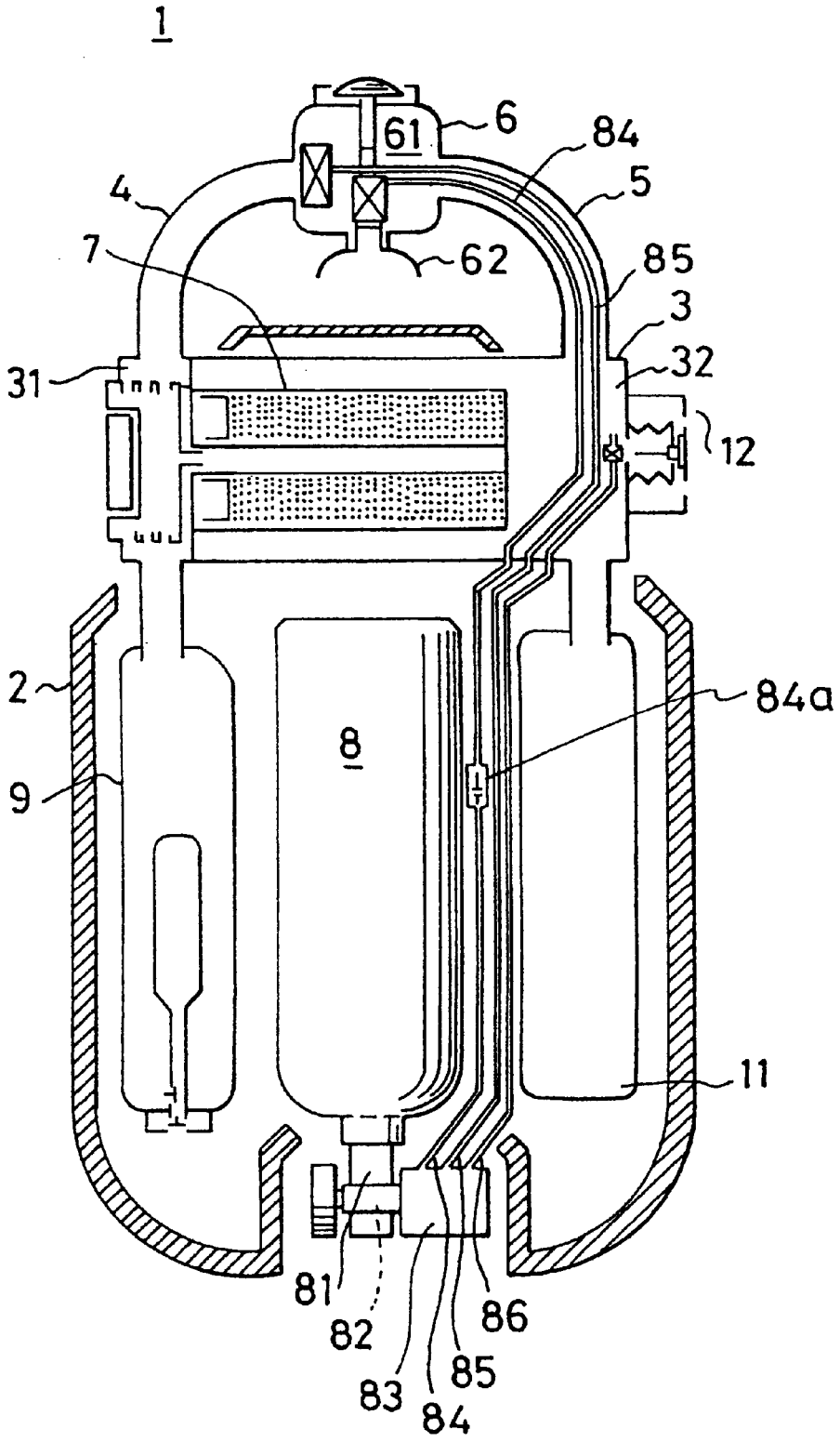
FIG. 7 is a schematic structural view showing the inner configuration of the semi-closed type breathing device of FIG. 6.

FIGS. 6 and 7 show the overall structure of a semi-closed type breathing device according to an embodiment of the invention. As shown in FIG. 6, the semi-closed type breathing device 1 of this example is equipped with a hollow housing 2 which contains the component parts of the device described below. One side or the housing 2 forms a back-resting surface 2*a* which rests against the back of the diver. Formed in the center of the opposing surface is an opening used for replacing the breathing gas cylinders. The opening has a removable cover 2*b*. Attached to the top edge of the housing 2 is a canister 3 with a built-in horizontal carbon dioxide adsorption apparatus The canister is basically cylindrical in shape. A flexible exhalation air hose 4 is connected to the peripheral surface on one side of the canister 3, and a flexible inhalation air hose 5 to the peripheral surface on the other side. The ends of the exhalation air hose 4 and the inhalation air hose 5 are connected to a mouth piece unit 6.

The main component parts of the device 1 and their connections will be described with reference to FIG. 7. As shown, an inhaled/exhaled air circulation chamber 61 is provided in the mouth piece unit 6 in communication with the exhalation air hose 4 and inhalation air hose 5. As described above, the other ends of the exhalation air hose 4 and inhalation air hose 5 are connected to either side of the cylindrical canister 3. More specifically, the canister 3 is provided with a built-in carbon dioxide adsorption apparatus 7 which has an annular cross-section and is located in a center portion of the canister. The apparatus 7 is formed on its both sides with an exhalation air passage 31 and an inhalation air passage 32, respectively.

A breathing gas cylinder 8 is arranged vertically in the center of the housing 2, below the canister 3 and between an exhalation air bag 9 and an inhalation air bag 11. The exhalation air bag 9 communicates with the exhalation air passage 31 of the canister 3 and the inhalation air bag 11 communicates with the inhalation air passage 32 of the canister 3.

The breathing gas cylinder 8 is arranged with its gas discharge outlet 81 positioned at the bottom, and it stores therein compressed air such as high oxygen-concentrated air comprising 40 percent of oxygen and 60 percent of nitrogen. The gas discharge outlet 81 is connected via an on/off valve 82 to a regulator 83. The regulator 83 is used to reduce the gas pressure to around 8 to 9 kg/cm$^2$. (The regulator 83 is connected by supply lines (not shown) to the BC jacket and the like, and on the high-pressure side has a remaining pressure gage line connector(not shown).)

One of the lines connected to the regulator 83 is a gas supply line 84, which extends to the middle of the mouth piece via the inhalation passage 32 of the canister 32 and the inhalation air hose 5. A flow rate adjustment orifice 84*a* interposed at an intermediate position is used to adjust the flow rate to 4 to 5 liters/minute for delivery to the mouth piece unit. Another line that runs to the mouth piece unit is gas supply line 85, which is used to supply gas to puree water from the interior of the mouth piece unit 6. The remaining line, gas supply line 86 is used to supply air during emergencies. The end of the supply line 32 is located within the inhalation air passage 32.

The inhalation end of the canister 3 has an auto-valve mechanism 12 which controls the opening and closing of the gas supply line 86 and the automatic release of excess gas.

The overall gas flow arrangement will now be described. Exhaled air from the mouth piece 62 of the mouth piece unit 6 passes into the exhalation air bag 9 via the exhalation air hose 4 and exhalation air passage 31. During inhalation, the accumulated exhaled air is passed through the carbon dioxide adsorption apparatus 7 to remove the carbon dioxide and purify the air, which then flows through the inhalation air passage 32, collects in the inhalation air bag 11 and is also supplied to the mouth piece unit 6 via the inhalation air hose 5 for inhalation. Inside the mouth piece unit 6, a constant flow of fresh inhalation gas is maintained from the cylinder 8, resulting in the supply of a mixture of gases for inhalation.

(Mouth Piece Unit)

FIGS. 1 to 5 show the structure and operation of the mouth piece unit of this example.

Figure 1:
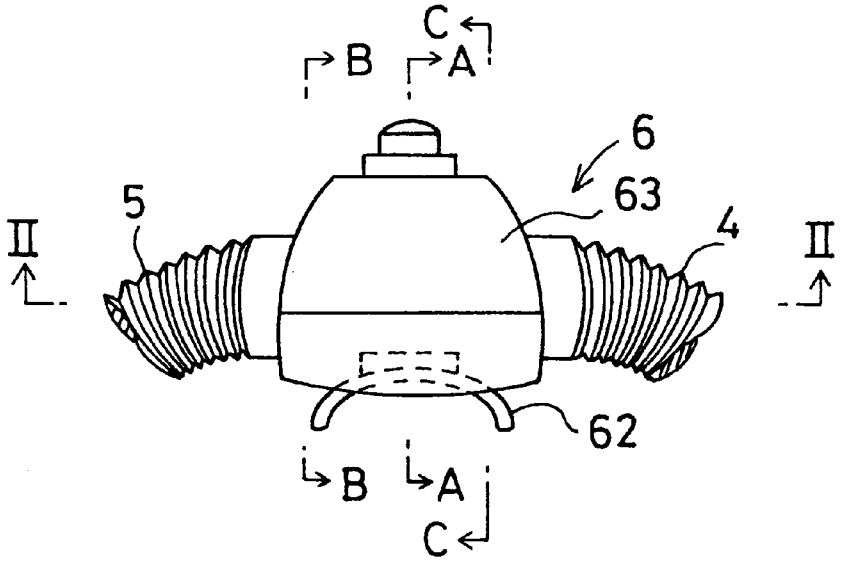
FIG. 1 is an illustration of a mouth piece unit according to the present invention.

At first, referring to FIGS. 1 to 3, the structure of the mouth piece unit 6 of this example will be described. The mouth piece unit 6 has a unit case 63, in which the inhaled/exhaled air circulation chamber 61 is defined. The inhaled/exhaled air circulation chamber 61 is communicated at its one lateral side with the exhalation air hose 4 via an exhalation air hose connecting port 61*a*, and at its opposite lateral side with the inhalation air hose 5 via an inhalation air hose connecting port 61*b*. The exhalation air hose connecting port 61*a* is provided with a check valve 61*c* that only permits passage of fluid toward the exhalation air hose 4. Similarly, the inhalation air hose connecting port 61*b* is provided with a check valve 61*d* that only permits passage of fluid toward the inhaled/exhaled air circulation chamber 61.

A movable assembly 70 is provided within the inhaled/exhaled air circulation chamber 61 so that it can be moved between an initial position shown in FIG. 3 and an operated position shown in FIG. 4 explained hereinafter. The movable assembly 70 has an outer tube arranged horizontally along the front and rear direction of the case in the inhaled/exhaled air circulation chamber 61 and an end wall 72 which is formed integrally on the rear end of the outer tube 71 and extends along the vertical direction of the case. The end wall 72 is formed at its center portion with an external opening 73. A mouthpiece attachment tube 74 is integrally formed on the outside surface of the end wall 72 so as to surround the external opening 73, and projects perpendicularly from the outside surface of the end wall 72. The mouth piece 62 is fixed on the outer periphery of the mouthpiece attachment tube 74.

A cylindrical diaphragm 75 is air-tightly fixed at its frond-side circular edge to the outer peripheral edge of the end wall 72. A rear-side circular edge of the diaphragm 75 is air-tightly fixed to the rear side portion of the unit case 63. A coil spring 76 is provided in an compressed condition between the end wall 72 and a rear end wall 63*l* of the unit case 63, whereby the end wall 72 is held pressed forward by spring force.

In the exhaled/inhaled air circulation chamber 61, a fixed assembly 90 is provided inside the outer tube 71 of the above-constituted movable assembly 70, which is fixed to the unit case 63 so as not to move. The fixed assembly 90 has an inner tube 91 coaxially arranged inside the outer tube 71 of the movable assembly 70, an external opening shut-off valve 92 mounted on the rear end of the inner tube 91, and an end plate 93 attached to the front end of the inner tube 91. At the front side of the end plate 93, a fixed tube 94 is provided in a condition coaxially with the inner tube 91, which projects outward passing through an opening 63*a* formed in the unit case 63. The fixed tube 94 is formed at its outer peripheral surface with a ring flange 94*a* which is fixedly mounted on the unit case 63. In addition, an outer-tube guiding tube 95 is provided in a condition that it covers the rear end portion of the fixed tube 94 and the front-end side outer periphery portion of the above inner tube 91. The above-mentioned outer tube 71 is slidably supported at its rear end side by the outer periphery surface of the outer-tube guiding tube 95.

The outer and inner tubes 71 and 91 are formed at their upper and lower wall portions with air communication holes 71*f*, 71*g* and 91*f*, 91*g*, respectively.

While, inside the fixed tube 94 of the above-constituted fixed assembly 90 is located a manually operating assembly 100 which has an actuating rod 101 coaxially arranged inside the fixed tube 94 and a start button 102 mounted on the front end of the actuating rod 101. The actuating rod 101 extends slidably passing through a center hole of the end plate 93 of the fixed assembly 90, a rear end of which is fixed with a large-diameter member 103 for preventing the rod from coming out of the center hole of the end plate. The member 103 is fixed with an engagement bar 104 extending along the lateral direction of the unit case 63.

The actuating rod 101 is surrounded by a cylindrical diaphragm 105 whose front and rear edges are fixed in an air-tight condition. A coil spring 106 in a compressed condition is inserted between the front end of the actuating rod 101 and the end plate 93, thereby constantly pressing the actuating rod 101 toward the front side of the unit case 63 by spring force.

The positions of the above-mentioned movable assembly 70, fixed assembly 90 and manually-operating assembly 100 will now be described. As well shown in FIG. 3(A), in an initial state, namely when out of use by the diver, the movable assembly 70 and manually operating assembly 100 are forced to locate at the front end side of the unit case 63 by means of the spring forces exerted by the coil springs 76 and 106. In this state, the start button 102 protrudes from the front surface of the unit case 63, and the external opening 73 of the end wall 72 of the movable assembly 70 is pressed against the external opening shut-off valve 92 and is closed. The mouth piece 62 is mounted on the mouthpiece attachment tube 74 located outside the end wall 72, almost all of which is retracted into an recess 63*b* defined by the end wall 72 and the diaphragm 75 at the rear side of the unit case 63. This position of the mouth piece is referred to as a "retracted position" in this specification.

Figure 2:
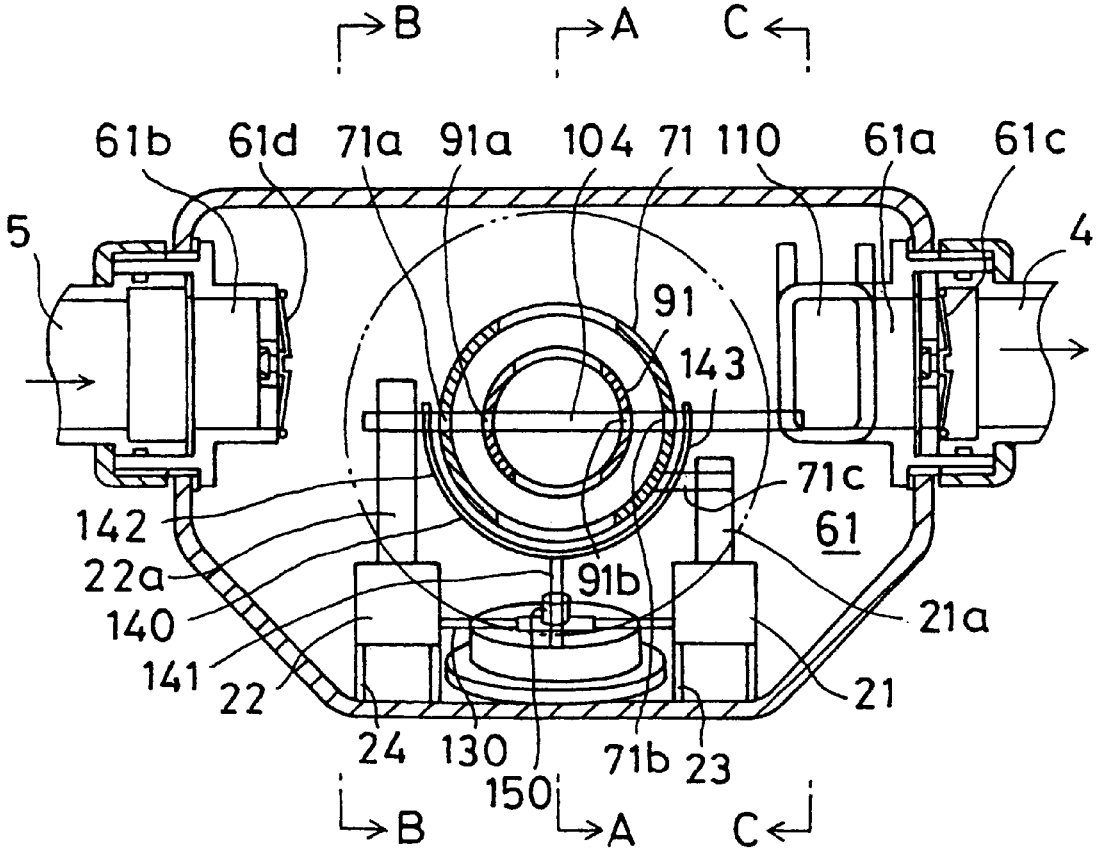
FIG. 2 is a schematic cross-sectional view of the mouth piece unit along line II—II of FIG. 1.

As can be seen from FIG. 2, one of the component parts of the manually operating assembly 100, or the engagement bar 104 extends to penetrate through the inner tube 91 of the fixed assembly 90 and the outer tube 71 of the movable assembly 78. The inner tube 91 is formed at both sides with engagement-bar through holes 91*a* and 91*b* which are elongated holes extending along the front and rear direction of the unit case, whereby the manually operating assembly 100 can be moved reciprocally along the front and rear directions of the unit case guided by these engagement-bar through holes 91*a*, 91*b*.

Figure 3A:
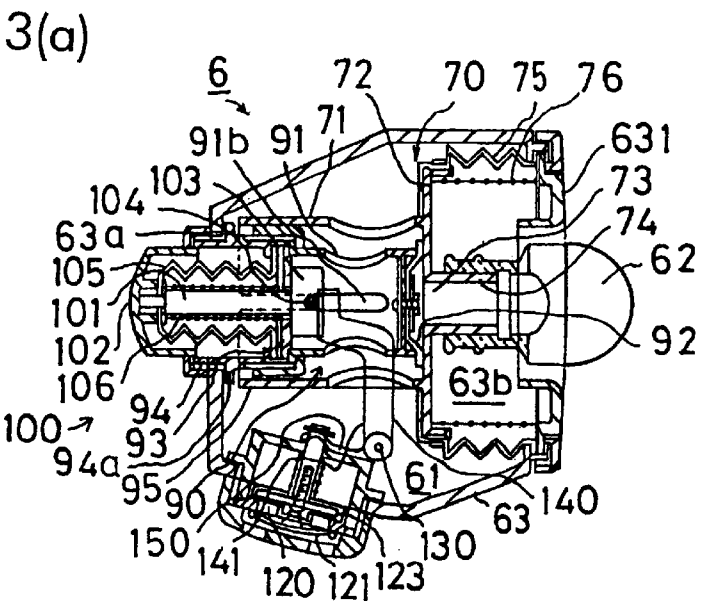
FIG. 3 illustrates positions of the respective elements of the mouth piece unit of FIG. 1 when it is out of use, wherein (A) is a schematic cross-sectional view along line A—A of FIG. 1, (B) is a schematic cross-sectional view along line B—B' or FIG. 1, and (C) is a cross-sectional view along line C—C of FIG. 1.
Figure 3B:
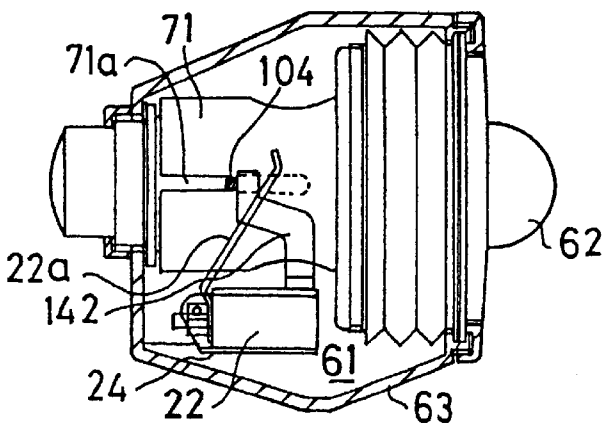

On the other hand, as shown in FIG. 3(B), the outer tube 71 of the movable assembly 70 is formed with elongated groove 71*a* and 71*b* by cutting it from the front edge thereof toward the rear side. The engagement bar 104 also passes laterally through the elongated grooves. Where the mouth piece 62 is located at the retracted position, the engagement bar 104 is in rightly contact with the front end of the elongated grooves 71*a*, 71*b* of the outer tube 71. If the manually-operating assembly 100 in this condition is pressed toward the rear side of the unit case, the outer tube 71 is pressed along the same direction by the engagement bar 104, namely the manually-operating assembly 100 is moved together with the movable assembly 70. However, in the opposite direction, the engagement bar 104 does not engage with the elongated grooves 71*a*, 71*b*, and therefore these members move separately Referring again to FIGS. 2 and 3, the remaining structure of the mouth piece unit 6 will be described. On the bottom surface of the inhaled/exhaled circulation chamber 61 of the unit case 63, an inhalation gas supply valve 21 and a purge gas supply valve 22 are provided in a manner that they are arranged along the front and rear direction and parallel with each other. The inhalation gas supply valve 21 is connected with the gas supply line 84 induced into the inhaled/exhaled air circulation chamber 61 via the inhalation air hose 5, while the purge gas supply valve 22 is connected with the purge gas supply line 85 induced into the inhaled/exhaled air circulation chamber also via the inhalation air hose 5.

The inhalation gas supply valve 21 located at the side of the exhalation air hose connecting port 61*a* is a normally closed valve, and is provided with a shift lever 21*a* projecting rearward and upward in an inclined state-which is used to shift the valve to an open state, as can be seen from FIGS.

2 and 3(C). The movable assembly 70 is also formed at its front end of the outer peripheral surface with a lever-actuating projection 71*c* projecting laterally. The lever-actuating projection 71*c* is positioned so that it comes in contact with the upper portion of the shift lever 21*a* and pushes it rearward as the outer tube 71 moves rearward. When the shift lever 21*a* is moved rearward by the lever-actuating projections 71*c*, the inhalation gas supply valve 21 is shifted from the closed state to the open state, thereby permitting the inhalation gas to supply into the inhaled/exhaled air circulation chamber.

Figure 3C:
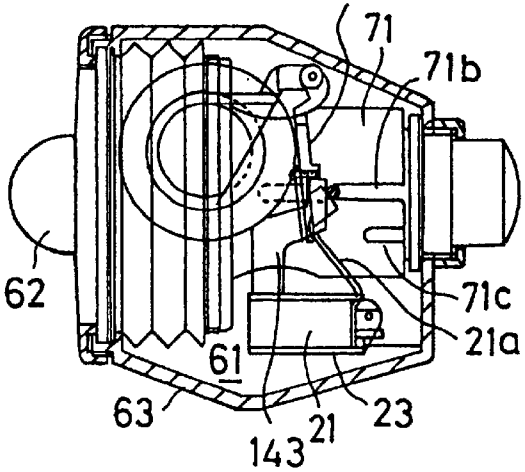

Similarly, the purge gas supply valve 22 located at the side of the inhalation air hose connecting port 61*b* is also a normally closed valve, and is provided with a shift lever 22*a* projecting rearward and upward in an inclined state which is used to shift the valve to an open state, as can be seen from FIGS. 2 and 3(C). The upper portion of the shift lever 22*a* is positioned on the moving locus of the engagement bar 104 of the manually operating assembly 100. In addition, when the engagement bar 104 reaches the most rear end side of the unit case along the elongated holes 91*a*, 91*b* of the inner tube 91 of the fixed assembly, in other words, when the manually operating assembly 100 comes into its actuated position, the shift lever 22*a* is pushed by the end of the engagement bar 104 to make the purge gas supply valve 22 an open state.

As shown in FIGS. 2 and 3(C), the exhalation air hose connecting port 61*a* is provided with the inhalation air hose shut-off valve 110 which is normally held open by means of resilient means such as a torsion spring or the like. The rear surface of this shut-off valve 110 is normally in contact with the end of the engagement bar 104 opposite to the end thereof where the shift lever 22*a* engages with. As shown in FIG. 3(C), the shut-off valve 110, by pivoted toward the rear side of the unit case around its upper end, closes the exhalation air hose connecting port 61*a*. Accordingly, by pressing to move the manually operating assembly 100 toward the unit case rear side, the engagement bar 104 makes the purge gas supply valve open as mentioned above, and at the same time the end of the engagement bar 104 presses the exhalation air hose shut-off valve 110 to close the exhalation air hose connecting port 61*a*.

As shown in FIGS. 2 and 3(A), there is provided a water draining opening 120 in the bottom wall of the unit case 63 between the inhalation gas supply valve 21 and the purge gas supply valve 22. The water draining opening 120 is provided with a check valve 121 which permits a fluid passage only from the inhaled/exhaled air circulation chamber 61 to the outside. Further, the water draining opening 120 is normally closed by a water draining opening shut-off valve 123.

There is also provided a pivot pin 130 extending along the lateral direction of the unit case 63 between the inhalation gas supply valve 21 and purge gas supply valve 22. More specifically, the pivot pin 130 is spun between brackets 23 and 24 by means of which the valves 21 and 22 are fixedly mounted on the unit case 63. The pivot pin 130 pivotally supports the lower end of a purge lever 140 which has a shaft portion 141, and left-side and right-side arc-shaped arm portions 142 and 143 branched laterally from the top of the shaft portion 141 and extending along the outer peripheral surface of the outer tube 71. The upper parts of these arm portions 142 and 143 are in engagement with the engagement bar 104 from the rear end side of the unit case.

The shaft portion 141 of the purge lever 140 is connected at its lower end with a shut-off valve engagement lever 150, which in turn supports a water draining opening shut-off valve 123. The purge lever 148 and the shut-off valve engagement lever 150 are pivotable integrally. As shown in FIG. 3, in a normal condition, the purge lever 140 is held in a upright state, while the water-draining opening shut-off valve 123 mounted on the shut-off valve engagement lever 150 is held in a state closing the water draining opening 120. When the manually operating assembly 100 is pressed down toward the rear end side of the unit case 63, the purge lever 140 is also pressed down about the pivot pin 130 toward the rear end side of the unit case 63 by means of the engagement bar 104. In response to the pivoting of the purge lever 140, the shut-off valve engagement lever 150 is pivoted upward to change the water draining opening shut-off valve 123 into an open condition. Consequently, water accumulated in the inhaled/exhaled air circulation chamber 61 can be discharged to the outside via the water draining opening 120.

Operation of Mouth Piece Unit

Operation of the above-constituted mouth piece unit 6 of this example will now be explained. FIG. 3 shows the positions of the respective elements of the mouth piece unit when it is not used, namely it is not held in the diver's mouth. In this state, the mouth piece 62 is held in the retracted position as mentioned above, and therefore the diver cannot hold it in the mouth.

Figure 4A:
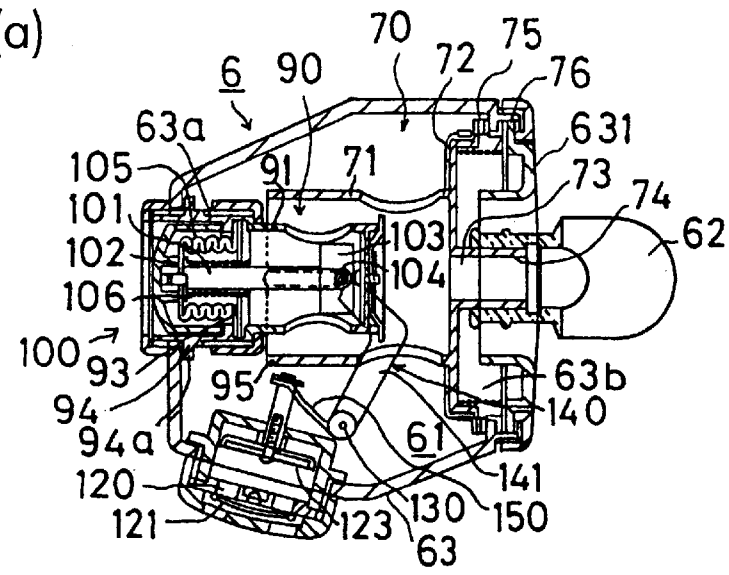
FIG. 4 illustrates positions of the respective elements of the mouth piece unit of FIG. 1 when it is used or in a purging condition, wherein (A) is a schematic cross-sectional view along line A—A or FIG. 1, (B) is a schematic cross-sectional view along line B—B of FIG. 1, and (C) is a cross-sectional view along line C—C of FIG. 1.
Figure 4B:
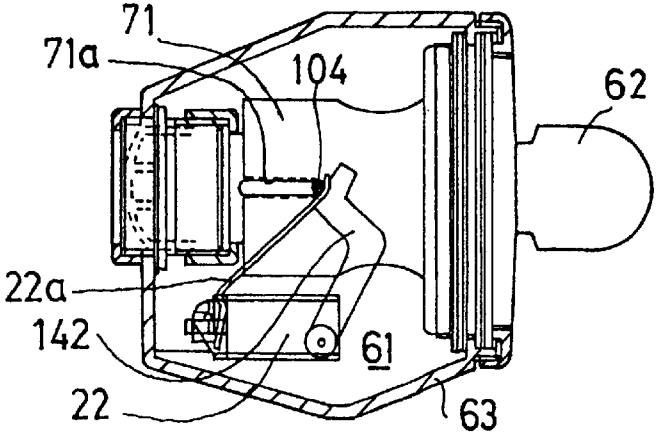
Figure 4C:
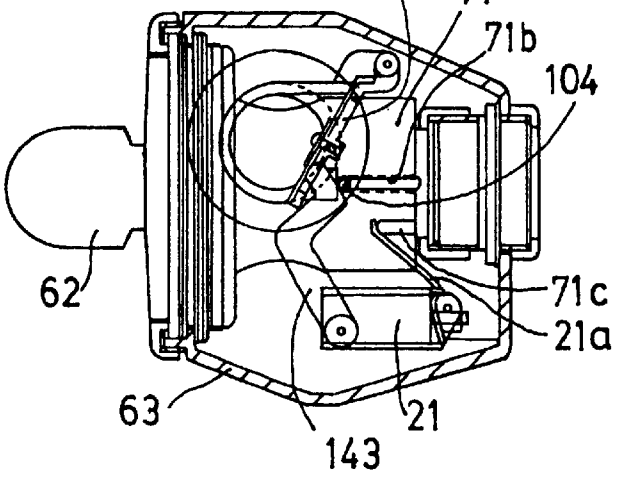

In this state, the start button 102 is pressed against the spring force toward the rear end side of the unit case 63 to the utmost limit, to cause the respective elements of the mouth piece unit 6 to change in position as shown in FIG. 4. Note that FIGS. 4(A), (B), (C) correspond to FIGS. 3(A), (B), (C), respectively. More specifically, the start button 102 is operated to press and move the manually operating member 102 from its initial position to its actuated position, to cause the engagement bar 104 positioned at the rear end side of the unit case to move. In accordance with the movement of the engagement bar 104, the purge lever 140 and the exhalation air hose shut-off valve 110, both engaged with the engagement bar 104, are forced to move toward the rear end side of the unit case. At the same time, the movable assembly 70 with its component part, or the outer tube 71 being in engagement with the engagement bar 104, is also moved toward the rear end side of the unit case as a whole.

As a result, the mouth piece 62 is moved together with the movable assembly 70 and is pushed out of the recess 63*b* at the rear end side of the unit case to project rearward as shown in FIG. 4(A). This projecting state of the mouth piece 62 is referred to as a "projected position" thereof. When the mouth piece 62 reaches the projected position, it is possible for the diver to hold it in the mouth. Further, in this state, the shift lever 21*a* is pressed by the projection 71*c* of the moved outer tube 71 to cause the inhalation gas supply valve 21 to become open, whereby the supply of inhalation gas into the inhaled/exhaled air circulation chamber is started.

Furthermore, in this state, the purge lever 140 in engagement with the engagement bar 104 is also pressed, to thereby open the water draining opening shut-off valve 123 and to close the exhalation air hose connecting port 61*a* by means of the exhalation air hose connecting port shut-off valve 110. At the same time, since the shift lever 22*a* is also pressed by the engagement bar 104, the purge gas supply valve 22 is opened to start the supply of purge gas at a flow rate which is higher than that of gas supplied by the inhalation gas supply valve 21.

Figure 5C:
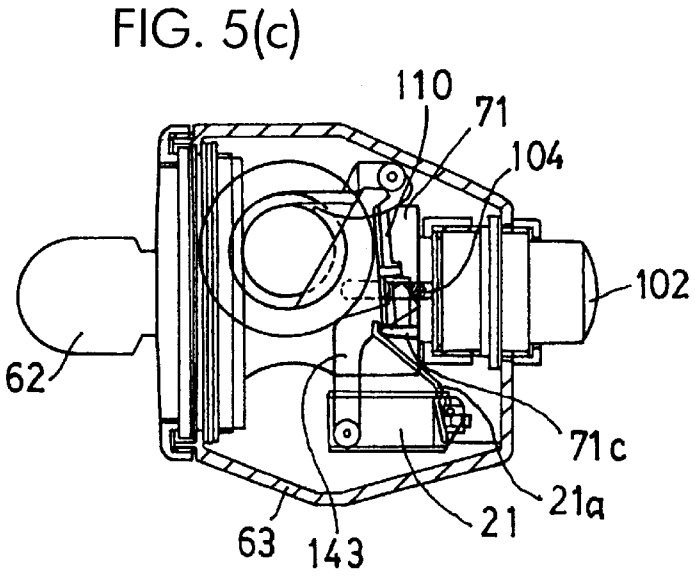
FIG. 5 illustrates positions of the respective elements of the mouth piece unit of FIG. 1 in a used condition, wherein (A) is a schematic cross-sectional view along line A—A of FIG. 1, (B) is a schematic cross-sectional view along line B—B of FIG. 1, and (C) is a cross-sectional view along line C—C of FIG. 1.
Figure 5A:
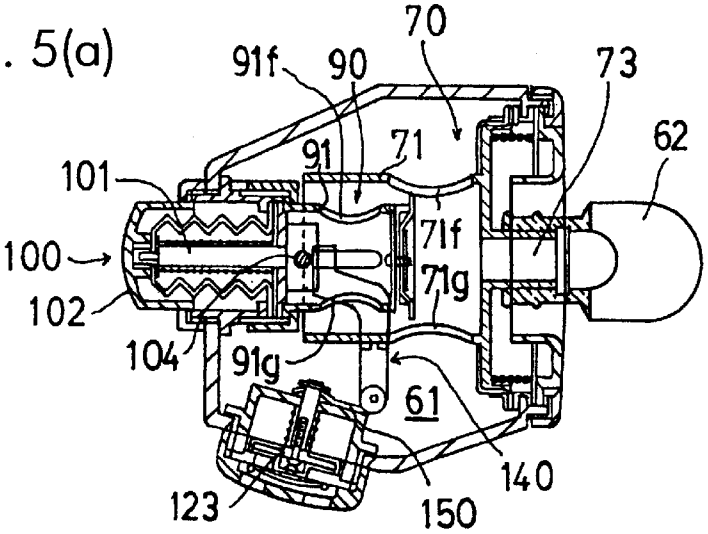
Figure 5B:
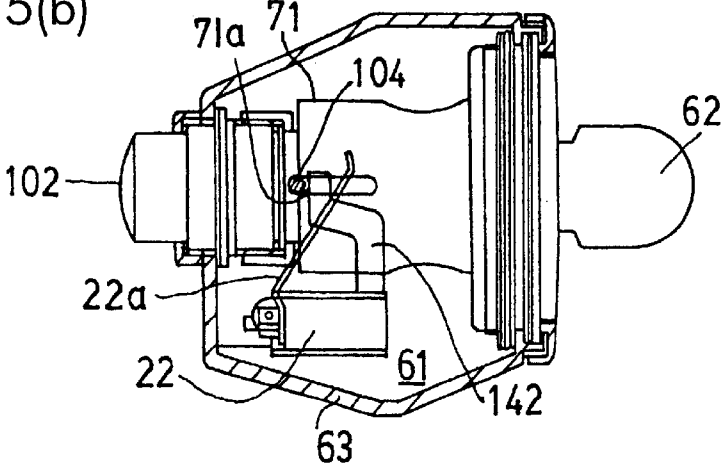

After the mouth piece 62 is held by the diver's mouth and the start button 102 is released, the manually operating assembly 100 returns to its original position (the initial position as shown in FIG. 3) together with the start button 102. The mouth piece 62 is, however, held in the diver's mouth, and therefore the movable assembly 70 fixed thereto will not return to its initial position, the state of which is shown in FIG. 5. In this state, the purge lever 140 and the exhalation air hose shut-off valve 110, which were pressed to move by the engagement bar 104 of the manually operating assembly 100, are returned to their initial position, so that the water draining opening 120 and the purge gas supply valve 22 are both closed.

However, since the movable assembly 70 is not returned to its initial position as mentioned above, the shift lever 21*a* is held in a condition being pressed by the projections 71*c* of the outer tube 71, so that the inhalation gas supply valve 21 is kept open to maintain the supply of the inhalation gas. Thus, the mouth piece unit is set to be ready for diving.

In the state as shown in FIG. 5, namely during diving wherein the diver holds the mouth piece in his/her mouth, the press of the start button 102 causes to establish the state shown in FIG. 4 again. Namely, the purge gas supply valve 22 is made open to start the supply of the purge gas into the inhaled/exhaled air circulation chamber 61 at a flow rate higher than that of the inhalation gas. At the same time, the exhalation air hose connecting port 61*a* is closed, while the shut-off valve for closing the water draining opening 120 is made open, whereby water accumulated in the mouth piece unit can be discharged to the outside via the water draining opening.

If the start button 102 is continued to press to maintain the supply of the purge gas, the inner pressure of the inhaled/exhaled air circulation chamber 61 becomes high compared to the external pressure. As a result, water in the inhaled/exhaled air circulation chamber is automatically discharged via the water draining opening 120.

When the start button 102 is released, it returns to its initial position (as shown in FIG. 3), together with the manually operating assembly 100, allowing the mouth piece unit to return to the state as shown in FIG. 5.

If the mouth piece 62 becomes dislodged accidentally from the diver's mouth when the diver is submerged, the entirety of the movable assembly 70 to which the mouth piece is mounted moves toward front end side to return the mouth piece to its initial state shown in FIG. 3. Consequently, the external opening 73 formed in the movable assembly 70 is forced to abut against the external opening shut-off valve 92 at the side of the stationary assembly 90, and becomes closed. Thus, it is able to prevent water from entering into the mouth piece unit 6 through the mouth piece 62 and the external opening 73.

Similarly, when the diver dislodges the mouth piece 62 from his/her mouth after diving, the external opening 73 and the inhalation gas supply valve 21 are closed to shut off the supply of inhalation gas.

As explained above, according to the mouth piece unit 6 of this example, the supply of inhalation gas is automatically started by pressing the start button 102 and holding the mouth piece 62 in the mouth. In addition, in this state, as long as the start button 102 is being pressed, the supply of purge gas is also continued to carry out an automatic water purging operation. Furthermore, if the mouth piece 62 comes out of the mouth, the external opening 73 is automatically shut off and at the same time the supply of inhalation gas is stopped. According to this example, inhalation gas can be supplied only when it is required. Further, water purging operation can be carried out by simple operation, that is, by pressing the start button. Moreover, if the mouth piece is dislodged from the diver's mouth, the external opening is automatically shut off, preventing the water entry automatically.

Other Modes for Carrying Out the Invention

In the above description, the present invention is applied to a semi-closed type breathing device. The present invention, however, can also be applied to a closed-type breathing device. Further, in consideration of the fact that the mouth piece unit must be prevented from the entry of foreign matters such as dust and the like through the mouth piece, the mechanism for opening and closing the external opening of the mouth piece unit according to the present invention can also be applied to a open-type breathing device.

Industrial Applicability

As is explained above, according to the mouth piece unit of the present invention, the supply of inhalation gas is automatically started by holding the mouth piece projecting out from the unit case in the diver's mouth. In addition, if the mouth piece comes out of the diver's mouth, the supply of inhalation gas is automatically stopped and at the same time the external opening communicating with the mouth piece is automatically closed. Furthermore, when the manually operating assembly is held in the operated position, purge gas is supplied to open the water draining opening and to close the exhalation air hose connecting port, whereby water accumulated in the mouth piece unit is automatically expelled to the outside. According to the present invention, a mouth piece unit can be realized that can easily be operated even by a novice.

We claim:

1. A breathing device for diving, comprising:

a unit case provided therein with an inhaled/exhaled air circulation chamber which has an exhalation air hose connecting port communicated with an exhalation air hose for circulating exhaled gas and an inhalation air hose connecting port communicated with an inhalation air hose for circulating inhalation gas;

a movable assembly having a mouth piece and an external opening for communicating the inhaled/exhaled air circulation chamber to the outside, the movable assembly is movably mounted in the unit case so that the movable assembly can be moved between a retracted position wherein the mouth piece is retracted into the unit case and a projected position wherein the mouth piece is projected out from the unit case to allow the mouth piece to be held in a diver's mouth;

a stationary assembly having an external opening shut-off valve which is arranged at a fixed position in the unit case so as to face the external opening;

a resilient means for pressing the movable assembly against the side of the stationary assembly to hold the mouth piece in the retracted position in order to close the external opening by means of the external opening shut-off valve; and a manually operating assembly which is mounted in the unit case so as to move from an initial position to an operated position and is normally held in the initial position by means of resilient force, and which forces to move the movable assembly so that the mouth piece reaches the projected position in response to the movement from the initial position to the operated position thereof, while it returns to the initial position from the operated position by the resilient force without interlocking the movable assembly.

2. The breathing device for diving according to claim 1, further comprising:

a gas supply means for supplying a constant flow rate of fresh inhalation gas into the inhaled/exhaled air circulation chamber from a breathing gas cylinder; and an opening means formed on the movable assembly for shifting the gas supply means into an open state from a closed state in response to the movement of the movable assembly when it is moved to cause the mouth piece to reach the projected position.

3. The breathing device for diving according to claim 2, further comprising:

a purge gas supply means for supplying gas at a flow rate higher than a constant flow rate of inhalation gas from the breathing air cylinder to the inhaled/exhaled air circulation chamber;

a water draining opening for communicating the inhaled/exhaled air circulation chamber to the outside via a check valve means;

a water draining opening shut-off valve means which holds the water draining opening in a closed state and which makes the water draining opening to an open state in response to the movement of the movable assembly when it is moved to cause the mouth piece to reach the projected position;

an opening means for opening the purge gas supply means in response to the movement of the movable assembly when it is moved to cause the mouth piece to reach the projected position; and an exhalation air hose shut-off valve means for closing the exhalation air hose connecting port in response to the movement of the movable assembly when it is moved to cause the mouth piece to reach the projected position.

4. The breathing device for diving according to claim 1, wherein the breathing device is of a semi-closed type constituted so that exhaled air recovered from the mouth piece is regenerated by being passed through carbon dioxide adsorption apparatus, and a mixture of the regenerated gas and a constant flow of fresh gas for inhalation supplied from the breathing gas cylinder is supplied to the mouth piece unit as inhalation gas and surplus gas is discharged to the outside.

* * * * *